US010767855B2

(12) United States Patent
Bulat et al.

(10) Patent No.: US 10,767,855 B2
(45) Date of Patent: Sep. 8, 2020

(54) METHOD AND EQUIPMENT FOR COMBUSTION OF AMMONIA

(71) Applicant: Siemens Aktiengesellschaft, Munich (DE)

(72) Inventors: Ghenadie Bulat, Lincoln (GB); Timothy Hughes, Wantage (GB); Jonathan May, Lincoln (GB); Ian Wilkinson, Witney (GB)

(73) Assignee: Siemens Aktiengesellschaft, Munich (DE)

( * ) Notice: Subject to any disclaimer, the term of this patent is extended or adjusted under 35 U.S.C. 154(b) by 412 days.

(21) Appl. No.: 15/739,371

(22) PCT Filed: Jun. 20, 2016

(86) PCT No.: PCT/EP2016/064222
§ 371 (c)(1),
(2) Date: Dec. 22, 2017

(87) PCT Pub. No.: WO2016/207117
PCT Pub. Date: Dec. 29, 2016

(65) Prior Publication Data

US 2018/0187883 A1 Jul. 5, 2018

(30) Foreign Application Priority Data

Jun. 23, 2015 (GB) ..... 1510999.4

(51) Int. Cl.
*F23R 3/34* (2006.01)
*F23C 6/04* (2006.01)
(Continued)

(52) U.S. Cl.
CPC ..... *F23C 6/042* (2013.01); *F23C 9/08* (2013.01); *F23N 5/003* (2013.01); *F23R 3/34* (2013.01);
(Continued)

(58) Field of Classification Search
CPC ..... F02C 3/04; F02C 3/20; F02C 3/22; F02C 3/28; F23R 3/34; F23R 3/40; F23R 2900/00002; F23R 2900/03341
See application file for complete search history.

(56) References Cited

U.S. PATENT DOCUMENTS 3,313,103 A 4/1967 Johnson
5,823,760 A 10/1998 Shelor et al.
(Continued)

FOREIGN PATENT DOCUMENTS

CN 103184941 A 7/2013
EP 2 378 096 A1 10/2011
(Continued)

OTHER PUBLICATIONS

Valera-Medina et al. "Ammonia, Methane and Hydrogen for Gas Turbines," Energy Procedia, vol. 75 , No. 75 , pp. 118-123 (2015).
(Continued)

*Primary Examiner* — Arun Goyal
(74) *Attorney, Agent, or Firm* — Schiff Hardin LLP

(57) ABSTRACT

In a method and system for the combustion of ammonia, wherein a first combustion chamber receives ammonia and hydrogen in controlled proportions, and an oxygen-containing gas such as air. Combustion of the ammonia and hydrogen produces nitrogen oxides among other combustion products. A second combustion chamber receives the nitrogen oxides along with further ammonia and hydrogen in further controlled proportions along with further oxygen-containing gas such as air. The nitrogen oxides are combusted into nitrogen and water.

13 Claims, 2 Drawing Sheets

(51) Int. Cl.
*F23N 5/00* (2006.01)
*F23C 9/08* (2006.01)

(52) U.S. Cl.
CPC ..... *F23C 2900/9901* (2013.01); *F23C 2900/99011* (2013.01); *F23J 2215/10* (2013.01); *F23J 2219/20* (2013.01); *F23N 2221/10* (2020.01); *F23R 2900/00002* (2013.01); *F23R 2900/03341* (2013.01)

(56) References Cited

U.S. PATENT DOCUMENTS

| | | | | |
|---|---|---|---|---|
| 2009/0133400 | A1 | 5/2009 | Callas | |
| 2010/0269516 | A1 | 10/2010 | Brautsch et al. | |
| 2012/0047870 | A1* | 3/2012 | Kasuga ..... | F02C 3/22 60/39.462 |

FOREIGN PATENT DOCUMENTS

| | | | |
|---|---|---|---|
| JP | 2009504964 | A | 2/2009 |
| JP | 2012255420 | A | 12/2012 |
| JP | 2014095370 | A | 5/2014 |
| JP | 2015031215 | A | 2/2015 |
| JP | 2015094496 | A | 5/2015 |
| WO | WO 2010082359 | A1 | 7/2010 |

OTHER PUBLICATIONS

Notice of Allowance dated Dec. 17, 2019 for Chinese Patent Application No. 201680037475.5.
Office Action dated May 28, 2020 issued for Japanese Patent Application No. 2017-566676.

* cited by examiner

METHOD AND EQUIPMENT FOR COMBUSTION OF AMMONIA

BACKGROUND OF THE INVENTION

Field of the Invention

The present invention relates to a method and equipment for combustion of ammonia.

Description of the Prior Art

Ammonia may be used as an energy storage material. Ammonia may be synthesized and stored for later combustion. Combustion of ammonia in a gas turbine may allow chemically-stored energy to be released into mechanical energy. However, combustion of ammonia produces nitrogen oxides NOx which should be removed from the exhaust gas in order to reach emission targets.

SUMMARY OF THE INVENTION

In accordance with the present invention, in a method and system for the combustion of ammonia, a first combustion chamber receives ammonia and hydrogen in controlled proportions, as well as an oxygen-containing gas, such as air. Combustion of the ammonia and hydrogen in the first combustion chamber produces nitrogen oxides, among other combustion products. The nitrogen oxide content of the combustion products of the first combustion chamber. Ammonia and hydrogen and oxygen-containing gas are introduced into a second combustion chamber in controlled amounts dependent on the measured nitrogen oxide content of the combustion products of the first combustion chamber. The proportions of ammonia and hydrogen and oxygen-containing gas are controlled so that an excess of ammonia is introduced into the second combustion chamber, over that required to react with the supplied hydrogen, so as to produce only nitrogen and water when combustion takes place in the second combustion chamber.

DESCRIPTION OF THE PREFERRED EMBODIMENTS

Figure 1:
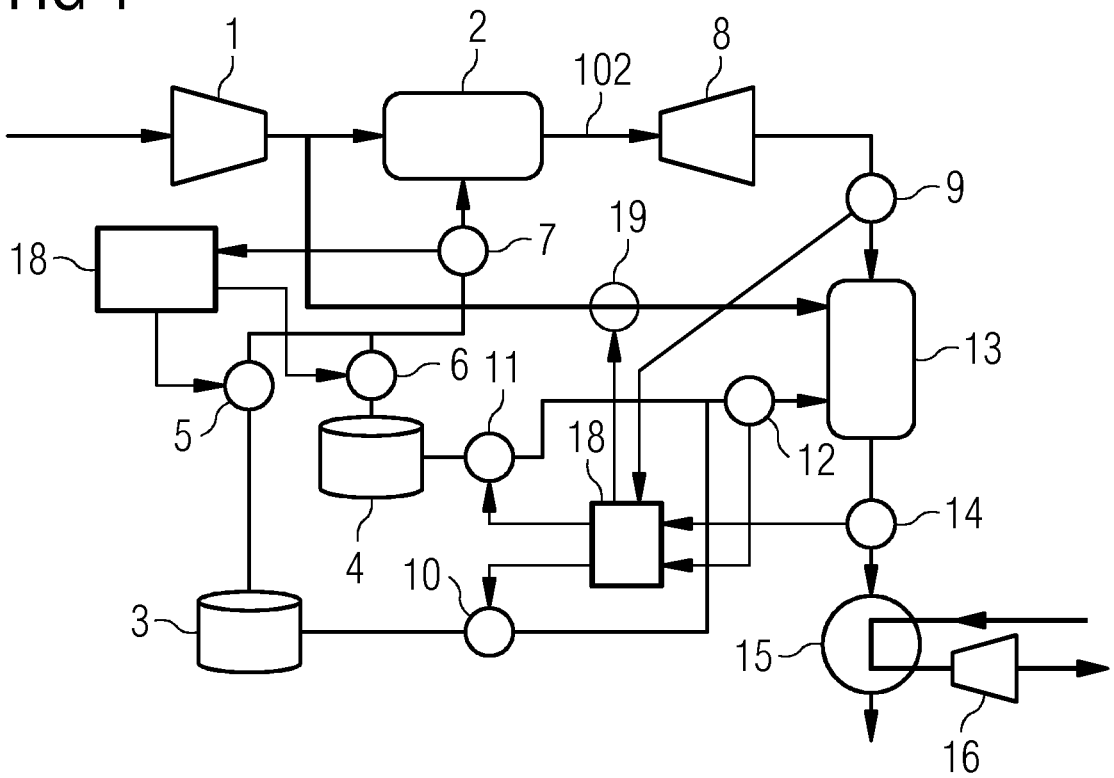
FIG. 1 is a flowchart of a first embodiment of the method according to the invention, as implemented by a system in accordance with the first embodiment of the method.

In a certain embodiment of the invention, illustrated in FIG. 1, an ammonia combustion includes a compressor 1 which compresses air, or other oxygen-containing gas, and passes it into a relatively high-pressure and high-temperature first combustion chamber 2. A first mixture of ammonia 3 and hydrogen 4 are added to the first combustion chamber

2 where combustion takes place producing heat and an exhaust gas flow. For example, the operational pressure within the first combustion chamber 2 may lie in the range 10-30 bar, with a typical operational pressure being in the range 12-25 bar.

The exit temperature of exhaust gases 102 from the first combustion chamber may be in the range 1400-2100 K, typically 1500-1800 K.

Control of the ratio of ammonia to hydrogen supplied to the first combustion chamber 2 is achieved by a controller 18 through mass flow controllers 5 and 6 coupled with an in situ gas analysis sensor 7. The gas mixture is optimized to deliver maximum power upon combustion. However, due to high combustion temperatures, and the high nitrogen content of the ammonia fuel, the exhaust gas flow 102 from the combustion chamber 2 will have high levels of nitrogen oxides NOR.

The exhaust gas 102 is provided to a first turbine 8 where work is transferred to a shaft or similar to provide a mechanical output. Exhaust gas leaving the first turbine 8 is hot and is routed to a second combustion chamber 13 operating in a relatively low pressure and relatively low temperature regime. For example, the operational pressure within the second combustion chamber 13 may lie in the range 1-10 bar, with a typical operational pressure being in the range 1-5 bar. The exit temperature of exhaust gases from the second combustion chamber may be in the range 300-1300 K, typically 750-880 K.

Prior to entering this second combustion chamber, the exhaust gas containing nitrogen oxides $NO_x$ is measured with an in situ gas analysis sensor 9.

A second mixture of ammonia 3, hydrogen 4 and air is injected into the second combustion chamber 13 with an enhanced equivalence ratio, typically 1.0-1.2, that is, an excess of ammonia over that required to react with the supplied hydrogen to produce only $N_2$ and $H_2O$. The mixture is combusted. The enhanced ratio ensures that the combustion produces significant proportion of $NH_{2^-}$ ions which combine with the nitrogen oxides $NO_x$ to produce $N_2$ and $H_2O$ thereby removing the $NO_x$ from the exhaust stream 102.

The exact equivalence ratio of ammonia to hydrogen in the second mixture is set by controller 18 using mass flow controllers 10, 11 and optionally an air mass flow controller 19 in conjunction with the in situ gas analysis sensor 12 to control the ammonia to hydrogen ratio, and optionally also the proportion of oxygen-containing gas such as air, in the second gas mixture supplied to the second combustion chamber 13. The required equivalence ratio is determined by measurement of the input $NO_x$ proportion by gas sensor 9 and by measurement of the output $NO_x$ emissions measured by in situ gas sensor 14. Controller 18 receives data from sensors 12, 9, 14 and issues appropriate commands to mass flow devices 11, 12 and optionally 19. Controller 18 may be the same controller as the controller associated with sensor 7 and mass flow devices 5, 6, or may be a separate controller.

A heat exchanger 15 may be used to remove waste heat and recover energy from discharge gases from the second combustion chamber. In the illustrated example, this is achieved by recovering heat in heat exchanger 15 and using this to drive steam turbine 16, although other mechanisms may be provided to recover energy from the waste heat, as appropriate.

Figure 2:
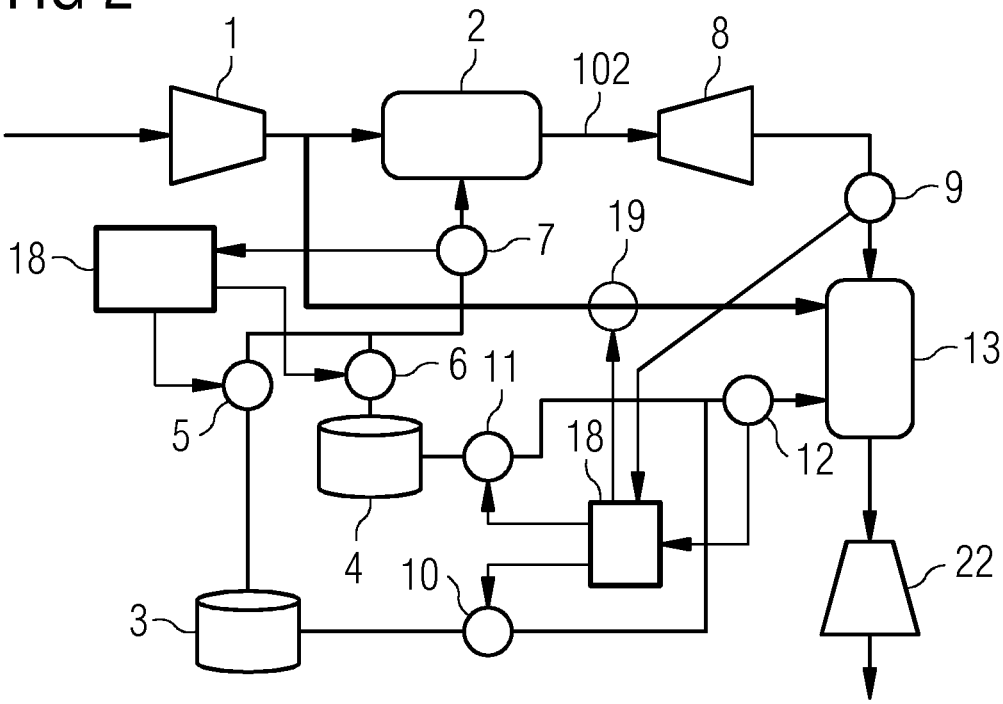
FIG. 2 is a flowchart of a second embodiment of the method according to the invention, as implemented by a system in accordance with the second embodiment of the method.

For example, as illustrated in FIG. 2, discharge gases from the second combustion chamber 13 may be routed to a second turbine 22 to recover waste energy as mechanical rotation.

Figure 3:
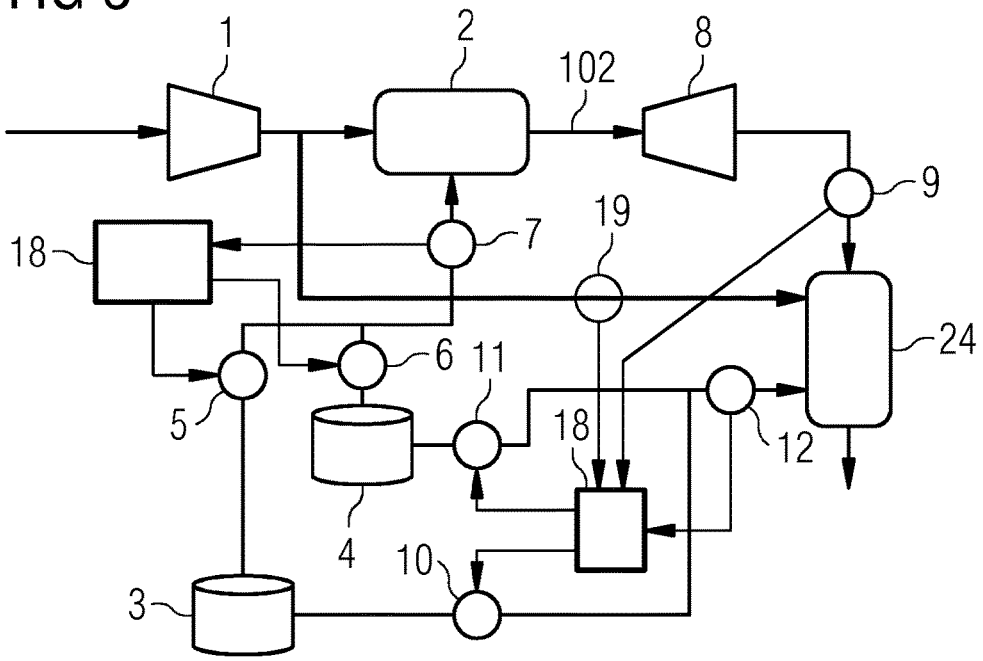
FIG. 3 is a flowchart of a third embodiment of the method according to the invention, as implemented by a system in accordance with the third embodiment of the method.

FIG. 3 shows another embodiment of the present invention. In this embodiment, second combustion chamber 24 has an integrated heat exchanger. This may be similar to a heat recovery steam generator with supplementary firing.

A heat recovery steam generator (HRSG) is a heat exchanger designed to recover the exhaust 'waste' heat from power generation plant prime movers, such as gas turbines or large reciprocating engines, thus improving overall energy efficiencies. Supplementary (or 'duct') firing uses hot gas turbine exhaust gases as the oxygen source, to provide additional energy to generate more steam if and when required. It is an economically attractive way of increasing system output and flexibility. Supplementary firing can provide extra electrical output at lower capital cost and is suitable for peaking. A burner is usually, but not always, located in the exhaust gas stream leading to the HRSG. Extra oxygen (or air) can be added if necessary. At high ambient temperatures, a small duct burner can supplement gas turbine exhaust energy to maintain the designed throttle flow to the steam turbine.

Figure 4:
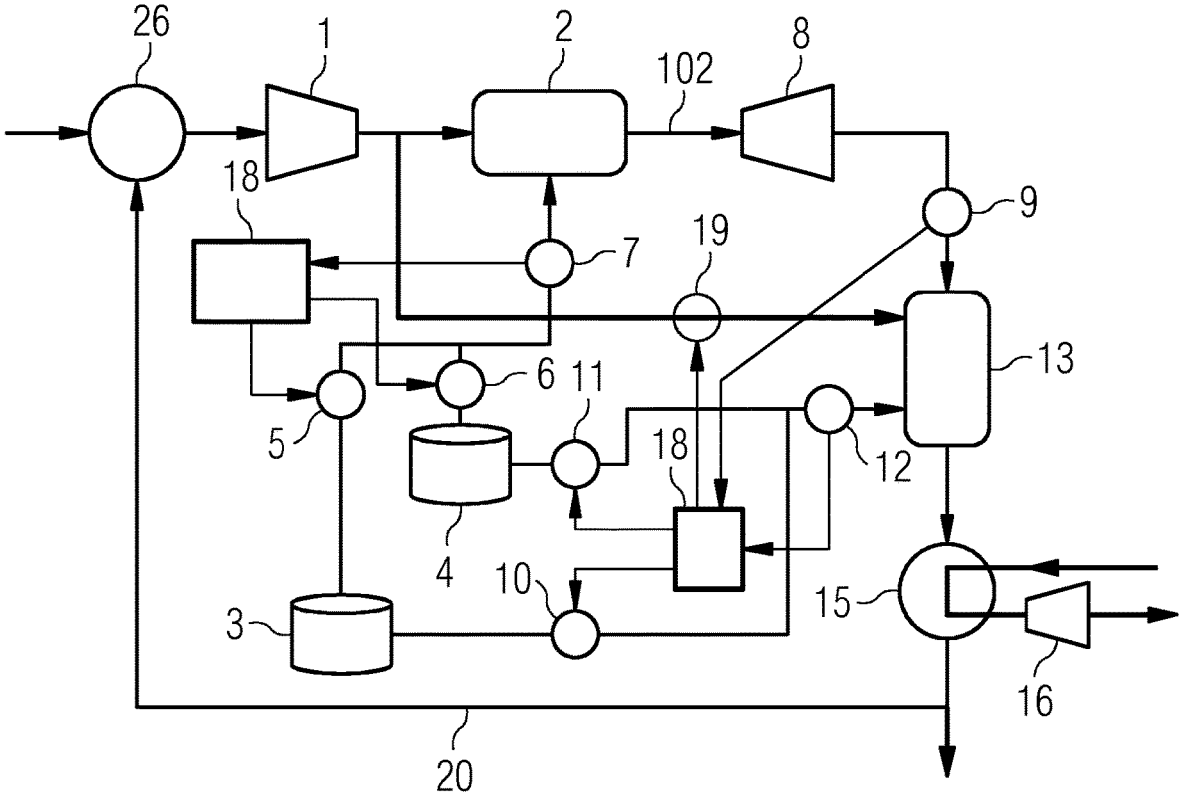
FIG. 4 is a flowchart of a fourth embodiment of the method according to the invention, as implemented by a system in accordance with the fourth embodiment of the method.

In a further embodiment of the present invention, illustrated in FIG. 4, a recirculation line 20 may be provided to recirculate a portion of the discharge gas from the second combustion chamber 13 back into the first combustion chamber 2. The recirculated discharge gas may be combined with the input gas flow, for example by mixing with intake oxygen-containing gas at mixer 26. This has the advantage that unburnt $NH_3$ in the exhaust gas is recycled and combusted. The proportion may be varied, for example between 0% and 80%, depending on the proportion of unburnt $NH_3$ in the exhaust gas from the second combustion chamber, and the acceptable proportion of $NH_3$ in discharge gases from the system.

The present invention accordingly aims to provide one or more of the following advantages:

(1)—nitrogen oxides $NO_x$ content is reduced or eliminated from the discharge gases;

(2)—overall efficiency of the system is maximised as all ammonia and hydrogen is converted to energy, nitrogen and water;

(3)—the first and second combustion chambers 2, 13, 24 can be located at a different location to the turbine(s) 8, 16, 22 so enabling various possible layouts to suit environmental constraints;

(4)—$NH_3$ content in the discharge gas is minimised.

The respective technical features that may contribute to the above advantages are as follows.

(1) Use of a second combustion chamber 13, 24 enables combustion under appropriate equivalence ratios to allow the formation of $NH_{2^-}$ ions. The subsequent combination with $NO_x$ in the discharge gas to form $N_2$ and $H_2O$ reduces the ammonia content of the discharge gas.

(2) Measurement 9 of the $NO_x$ content in the exhaust gas 102 from turbine 8 prior to input into the second combustion chamber, control of the $NH_3/H_2$ gas mass flows into the first combustion chamber and measurement 14 of the $NO_x$ emissions at the output of the second chamber allow the exact setting of the equivalence ratio according to the $NO_x$ content of the exhaust gas and discharge gas. This is necessary because the burn conditions in the first combustion chamber will determine the $NO_x$ content of the exhaust gases 102. These conditions can change on a dynamic basis and from system to system.

(3) Use of a heat exchanger 15, 24 to minimize the energy loss associated with the second combustion in the second combustion chamber 13, 24.

(4) Recirculation of discharge gas from the second combustion chamber back to the first combustion chamber acts to minimize $NH_3$ emissions.

The present invention accordingly provides methods and systems for combustion of ammonia, as defined in the appended claims.

Energy from the combustion in the first combustion chamber 2 may be recovered by operation of a first turbine 8 to convert the energy released by combustion in the first combustion chamber into mechanical energy.

Energy from the combustion in the second combustion chamber 13 may be recovered by operation of a second turbine 16, 22 to convert the energy released by combustion in the second combustion chamber into mechanical energy. Operation of the second turbine 22 may be by direct action of exhaust gases from the second combustion chamber 13 on the turbine 22, or by heating of water in a heat exchanger 15 to drive second turbine 16 by steam.

The second combustion chamber 24 may incorporate a heat exchanger for recovery of heat from exhaust gases from the second combustion chamber. The heat exchanger may serve to heat steam for the recovery of heat.

A proportion of discharge gases from the second combustion chamber may be recirculated into the first combustion chamber in order to provide combustion to ammonia remaining in the exhaust gases.

While the present application has been described with reference to a limited number of particular embodiments, numerous modifications and variants will be apparent to those skilled in the art.

The invention claimed is:

1. A method for combustion of ammonia, comprising:

introducing ammonia and hydrogen into a first combustion chamber in controlled proportions, along with an oxygen-containing gas, so that combustion of the ammonia and the hydrogen takes place in the first combustion chamber and produces nitrogen oxides, among other combustion products;

measuring a nitrogen oxide content of combustion products of the first combustion chamber;

introducing the nitrogen oxides into a second combustion chamber, along with further ammonia and further hydrogen in further controlled proportions, along with further oxygen-containing gas, so that combustion of the nitrogen oxides in said second combustion chamber produces nitrogen and water;

controlling the further controlled proportions of said further ammonia, said further hydrogen and said further oxygen-containing gas dependent on the nitrogen oxide content of the combustion products of the first combustion chamber so that an excess of said further ammonia is introduced into said second combustion chamber over an amount required to react with said further hydrogen introduced into said second combustion chamber, so that combustion of the nitrogen oxides produces only nitrogen and water; and capturing discharge gases from said second combustion chamber, and recirculating a portion of the discharge gases into said first combustion chamber in order to produce combustion-to of ammonia that remains in said first combustion chamber of discharge gases.

2. A method as claimed in claim 1 comprising recovering energy from the combustion in the first combustion chamber by operating a turbine that converts energy released by the combustion in the first combustion chamber into mechanical energy.

3. A method as claimed in claim 1 comprising recovering energy from the combustion in the second combustion chamber by operating a turbine that converts energy released by the combustion in the second combustion chamber into mechanical energy.

4. A method as claimed in claim 3 comprising operating said turbine by direct action of exhaust the discharge gases from the second combustion chamber on the turbine.

5. A method as claimed in claim 3 comprising operating said turbine by heating water in a heat exchanger in order to drive the turbine by steam.

6. A method as claimed in claim 3 comprising recovering heat from said second combustion chamber by an integrated heat exchanger.

7. A system for combustion of ammonia, comprising:

a first combustion chamber;

a first controller that introduces ammonia and hydrogen into said first combustion chamber in controlled proportions, along with an oxygen-containing gas, so that combustion of the ammonia and the hydrogen takes place in the first combustion chamber and produces exhaust gases including nitrogen oxides, among other combustion products;

a sensor that measures a nitrogen oxide content of tho combustion products of the first combustion chamber;

a second combustion chamber;

a second controller that introduces the nitrogen oxides into said second combustion chamber, along with further ammonia and further hydrogen in further controlled proportions, along with further oxygen-containing gas, so that combustion of the nitrogen oxides in said second combustion chamber produces nitrogen and water;

said second controller being in communication with said sensor and being configured to control the further controlled proportions of said further ammonia, said further hydrogen and said further oxygen-containing gas dependent on the nitrogen oxide content of the combustion products of the first combustion chamber so that an excess of said further ammonia is introduced into said second combustion chamber over an amount required to react with said further hydrogen introduced into said second combustion chamber, so that combustion of the nitrogen oxides produces only nitrogen and water; and a recirculation line that recirculates a portion of discharge gases from said second combustion chamber back into said first combustion chamber.

8. A system as claimed in claim 7 comprising a turbine connected to receive the exhaust gases from the first combustion chamber so as to convert energy released by the combustion in the first combustion chamber into mechanical energy and to provide the exhaust gases to the second combustion chamber.

9. A system as claimed in claim 8 wherein said turbine is a first turbine, and said system comprising a second turbine connected to receive the discharge gases from the second combustion chamber.

10. A system as claimed in claim 9 wherein said turbine is operated by direct action of said discharge gases from the second combustion chamber on the second turbine.

11. A system as claimed in claim 8 wherein said turbine is a first turbine, and said system comprises a heat exchange and a second turbine, said heat exchanger being connected to receive discharge gases from said second combustion chamber, and said heat exchanger heating water in said heat exchanger in order to produce steam that drives the second turbine.

12. A system as claimed in claim 11 wherein said heat exchanger is integrated into said second combustion chamber.

13. A system as claimed in claim 7 comprising a mixer connected to said recirculation line, said mixer mixing said portion of discharge gases from said second combustion chamber, which are recirculated back into said first combustion chamber, with intake oxygen-containing gas.

* * * * *